US007105758B2

(12) United States Patent
Nakanishi et al.

(10) Patent No.: US 7,105,758 B2
(45) Date of Patent: Sep. 12, 2006

(54) SWITCH

(75) Inventors: Yoshito Nakanishi, Machida (JP); Kunihiko Nakamura, Sagamihara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 147 days.

(21) Appl. No.: 10/490,395

(22) PCT Filed: Jun. 5, 2003

(86) PCT No.: PCT/JP03/07106

§ 371 (c)(1),
(2), (4) Date: Apr. 7, 2004

(87) PCT Pub. No.: WO03/105175

PCT Pub. Date: Dec. 18, 2003

(65) Prior Publication Data

US 2004/0239455 A1 Dec. 2, 2004

(30) Foreign Application Priority Data

Jun. 11, 2002 (JP) ..... 2002-170613

(51) Int. Cl.
*H01H 57/00* (2006.01)

(52) U.S. Cl. ..... 200/181; 310/308; 310/309

(58) Field of Classification Search ..... 335/78–86; 200/181; 310/308–310
See application file for complete search history.

(56) References Cited

U.S. PATENT DOCUMENTS 6,504,118 B1 * 1/2003 Hyman et al. ..... 200/181
2004/0056742 A1 * 3/2004 Dabbaj ..... 335/78

FOREIGN PATENT DOCUMENTS

| | | |
|---|---|---|
| JP | 5-185383 | 7/1993 |
| JP | 2738028 | 4/1998 |
| JP | 11-176307 | 7/1999 |
| JP | 2000-15805 | 1/2000 |
| KR | 10-2002-0034764 | 5/2002 |

OTHER PUBLICATIONS

English Language Abstract of JP 11-76307, no date.
English Language Abstract of JP 2000-15805, no date.
English Language Abstract of JP 5-185383, no date.
English Language Abstract of JP 2738028, no date.
IEEE Microwave and Wireless Components Letters, vol. 11, No. 8, Aug. 2001, pp. 334-336, Inline Capacitive and DC-Contact MEMS Shunt Switches.
English Language Abstract of KR 10-2002-0034764.

* cited by examiner

*Primary Examiner*—Ramon M. Barrera
(74) *Attorney, Agent, or Firm*—Greenblum & Bernstein, P.L.C.

(57) ABSTRACT

A switch that is capable of responding at a high rate at a lower DC potential while providing high isolation. In this switch, a microstructure group, having microstructures, is used. By slightly moving the microstructures a small amount the group, as a whole, achieves a large amount of movement. Also, by this configuration, it is possible to decrease a DC potential to apply to control electrodes of the microstructures. As a result, a high isolation switch capable of operating at a high rate at a lower DC potential is realized.

20 Claims, 14 Drawing Sheets

SWITCH

TECHNICAL FIELD

The present invention relates to a switch for use in a wireless communication circuit or the like.

BACKGROUND ART

In the prior art technique, microscopic switches of the size of several hundred micrometers have been known, as described in *IEEE Microwave and Wireless Components letters*, Vol. 11 No. 8, August 2001, p 334.

FIG. 1 is a cross sectional view showing the configuration of a conventional switch 10 as described in the above reference, and FIG. 2 is a top view of the conventional switch 10. FIG. 1 is a cross sectional view along A—A line of FIG. 2. This switch 10 has a membrane (Switch Membrane) on which a signal line 11 for transmitting high frequency signals is formed, while a control electrode 12 is provided directly below the above signal line 11.

When a DC potential is applied to the control electrode 12, the membrane is attracted to the control electrode 12 by electrostatic attractive force, and bends so as to come into contact with a ground electrode (Ground Metal) 14 formed on the substrate 13, so that the signal line 11 formed on the membrane is short circuited, to attenuate and block the signal passing through the signal line 11.

In contrast to this, when no DC potential is applied to the control electrode 12, the membrane does not bend, so that the signal passing through the signal line 11 formed on the membrane can pass through the switch 10 without loss from the ground electrode 14.

However, in the case of the conventional switch 10, the DC potential required for attracting the membrane to the control electrode 12 is 30 V or higher, and there is a problem that it is difficult to implement a mobile wireless terminal with the switch 10 requiring this high voltage.

Also, when the membrane is attracted to the control electrode 12 to block the signal, the impedance of the signal line 11 is short circuited, and reflection occurs when the high frequency signal passes, to make it necessary to provide parts such as a circulator and the like.

DISCLOSURE OF INVENTION

It is an object of the present invention to provide a high isolation switch capable of responding at a high rate at a lower DC potential.

In accordance with one aspect of the present invention, a switch comprises: a movable member with a plurality of surface electrodes on a surface thereof; a first terminal provided on a portion of the movable member; and a second terminal provided on a portion of the movable member to output a signal passing between the second terminal and the first terminal to a predetermined external terminal, wherein the switch switches between passing and blocking of the signal between the second terminal and the predetermined external terminal by modifying in shape the movable member by an electrostatic attractive force induced between the plurality of surface electrodes.

In accordance with another aspect of the present invention, a switch comprises: a plurality of structures that are provided with a plurality of surface electrodes on a surface thereof and that are movable in an arbitrary direction; a beam that transfers an input signal between the structures and that links the structures to each other in order that at least two pairs of the surface electrodes on the structures are opposed to each other; a control signal line that transfers a control signal to each surface electrode; an input terminal provided in a structure located at one end of a structure group having the structures linked to each other to input the input signal to the structure located at the one end and fix the structure located at the one end to a substrate; and an output terminal provided in a structure located at the other end of the structure group to output the input signal to a predetermined external terminal, wherein the switch switches between passing and blocking of the input signal between the output terminal and the predetermined external terminal by moving the other end of the structure group by a distance larger than a relative distance between the surface electrodes by inducing an electrostatic attractive force between the surface electrodes opposed to each other between the structures to change the relative distance between the surface electrodes , and changing a degree of electrical coupling between the output terminal and the predetermined external terminal.

In accordance with a further aspect of the present invention, a switch comprises: a double supported beam provided on a substrate; a stationary electrode located directly below the double supported beam; a movable electrode provided on a surface of the double supported beam facing the substrate; and a plurality of surface electrodes provided on a surface of the double supported beam opposite the surface on which the movable electrode is provided, wherein the switch switches between passing and blocking of a signal between the double supported beam and the substrate by inducing an electrostatic attractive force between the stationary electrode and the movable electrode and inducing an electrostatic attractive force between the plurality of surface electrodes to bend the double supported beam and change a degree of electrical coupling between the double supported beam and the substrate.

In accordance with a still further aspect of the present invention, a switch comprising: a cantilever beam provided on a substrate; a stationary electrode located directly below the cantilever beam; a movable electrode provided on a surface of the cantilever beam facing the substrate; and a plurality of surface electrodes provided on a surface of the cantilever beam opposite the surface on which the movable electrode is provided, wherein the switch breaks electrical coupling between the cantilever beam and the substrate by inducing an electrostatic attractive force between the stationary electrode and the movable electrode to bend and electrically couple the cantilever beam with the substrate, and by inducing an electrostatic attractive force between the plurality of surface electrodes to generate a compressive stress in the cantilever beam in a direction of separating the cantilever beam from the substrate.

BEST MODE FOR CARRYING OUT THE INVENTION

Embodiments of the present invention will be explained in detail below with reference to the accompanying drawings.

EMBODIMENT 1

Figure 1:
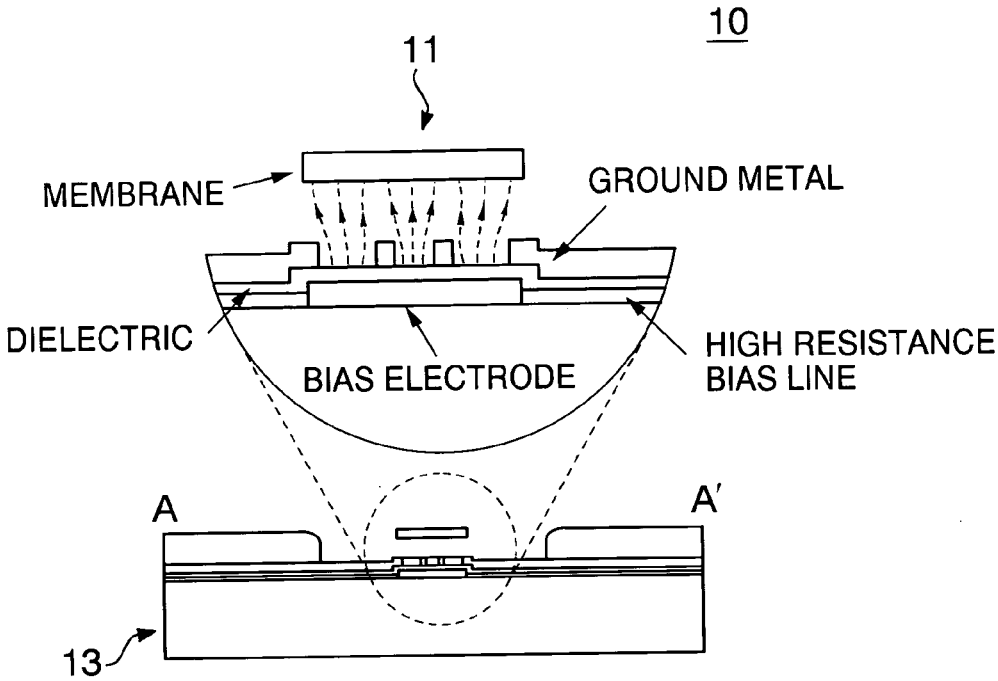
PRIOR ART FIG. 1
FIG. 1 is a cross sectional view showing a conventional switch.
Figure 2:
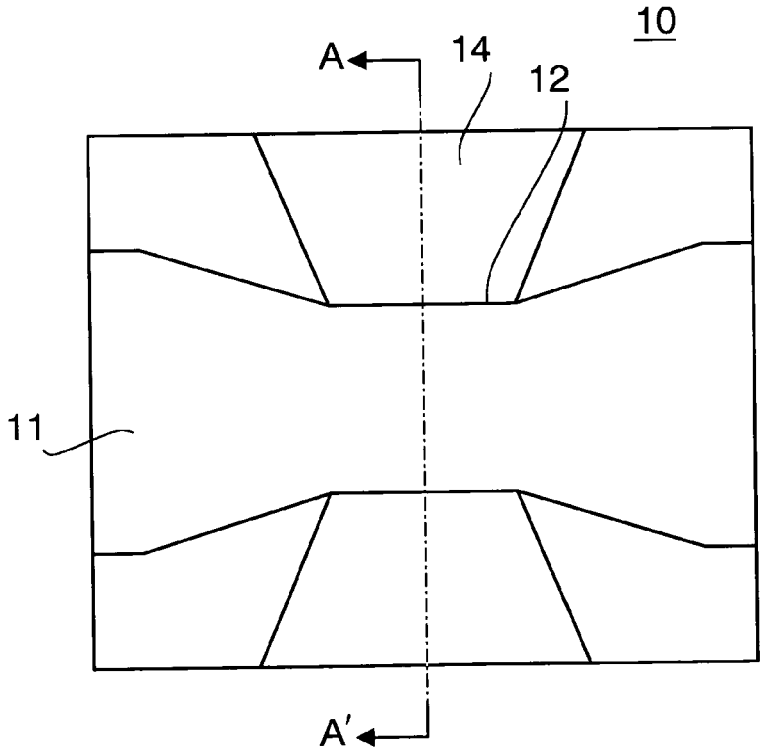
PRIOR ART FIG. 2
FIG. 2 is a top view of the conventional switch.
Figure 3:
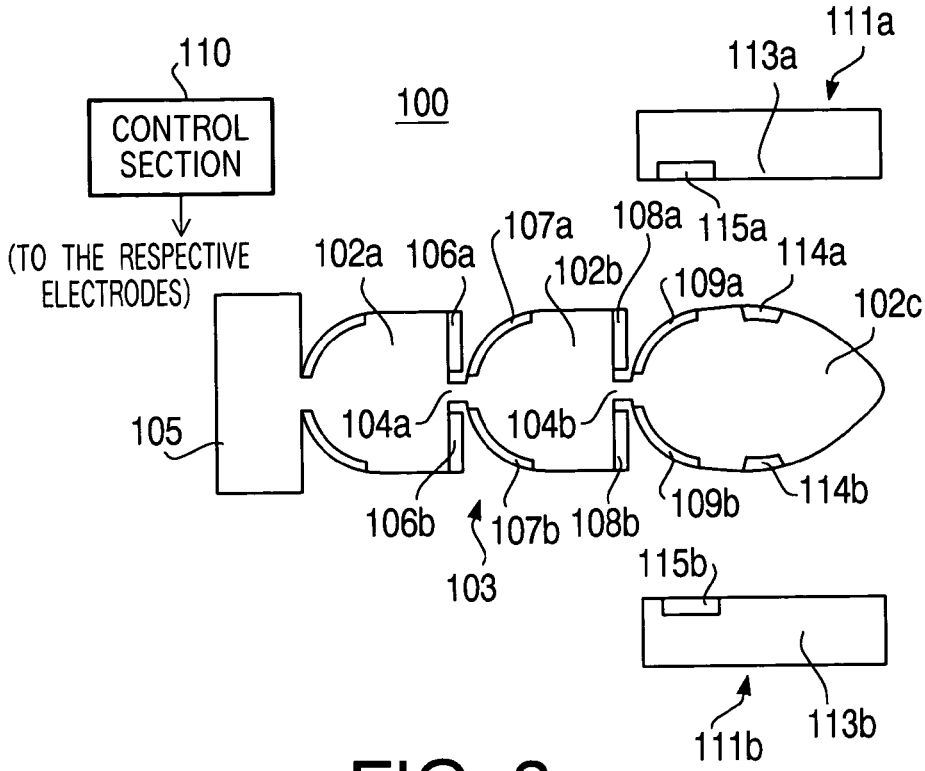
FIG. 3 is a plan view showing the configuration of a switch in accordance with embodiment 1 of the present invention.

FIG. 3 is a plan view showing the configuration of a switch in accordance with embodiment 1 of the present invention. The switch 100 shown in FIG. 3 includes a microstructure group 103 including a plurality of microstructures 102*a*, 102*b* and 102*c*, forming an SPDT switch which moves on the substrate in the planar direction. This switch 100 is formed on a semiconductor integrated circuit by the same process as the integrated circuit and used in the transmitter circuit, the receiver circuit, the transmission/reception switching circuit of a wireless communication device, or in some circuits of a variety of other devices.

The microstructures 102*a*, 102*b* and 102*c* are made of polysilicon which makes it possible to firmly form an electrode on their surfaces, with an insulating film formed over the surface of the silicon. However, the present invention is not limited thereto, but can be practiced by the use of a polymer base material such as polyimide, or a silicon base material (SiGe, SiGeC) and the like which can be processed at a low temperature. The microstructures 102*a*, 102*b* and 102*c* made of the above material are linked in series by linking beams 104*a* and 104*b*, respectively. Of these plural microstructures 102*a*, 102*b* and 102*c* linked in series, the microstructure 102*a* at one end is linked to a substrate side input section 105 provided in the substrate side. Also, the microstructure 102*b* linked to this microstructure 102*a* located at the one end through the linking beam 104*a* can move on the substrate with a supporting point of the linking beam 104*a* between the microstructure 102*b* and the microstructure 102*a*.

Furthermore, the microstructure 102*c* linked at the other end to the microstructure 102*b* through the linking beam 104*b* can move on the substrate with a supporting point of the linking beam 104*a* between the microstructure 102*c* and the microstructure 102*b*.

Accordingly, the plurality of the microstructures 102*a*, 102*b* and 102*c* linked by the linking beams 104*a* and 104*b* are arranged with the microstructure 102*a* located at the one end as a supporting point around which the pivoting motion of the microstructure 102*c* is enabled at the other end on the substrate in the planar direction thereof.

The length of each of the microstructures 102*a*, 102*b* and 102*c* is of the size of about 100 μm while the total length of the microstructure group 103 made of the plurality of the microstructures 102*a*, 102*b* and 102*c* linked in series is no larger than about 500 μm. By selecting these dimensions, it is possible to avoid an increase in the signal loss due to an oversized structure and a decrease in the amount of movement due to an undersized structure and secure a sufficient isolation.

Incidentally, while the microstructure group 103 as a movable member is composed of the three microstructures 102*a*, 102*b* and 102*c* in the case of this embodiment 1, the present invention is not limited thereto, and it is possible to use a different number of microstructures.

A portion of the microstructure 102*a* opposed to the microstructure 102*b* is formed with a flat end portion on which surface electrodes 106*a* and 106*b* are provided. Also, a portion of the microstructure 102*b* opposed to the microstructure 102*a* is formed with a curved end portion on which surface electrodes 107*a* and 107*b* are provided.

Also, a portion of the microstructure 102*b* opposed to the microstructure 102*c* is formed with a flat end portion on which surface electrodes 108*a* and 108*b* are provided. Also, a portion of the microstructure 102*c* opposed to the microstructure 102*b* is formed with a curved end portion on which surface electrodes 109*a* and 109*b* are provided.

Figure 4:
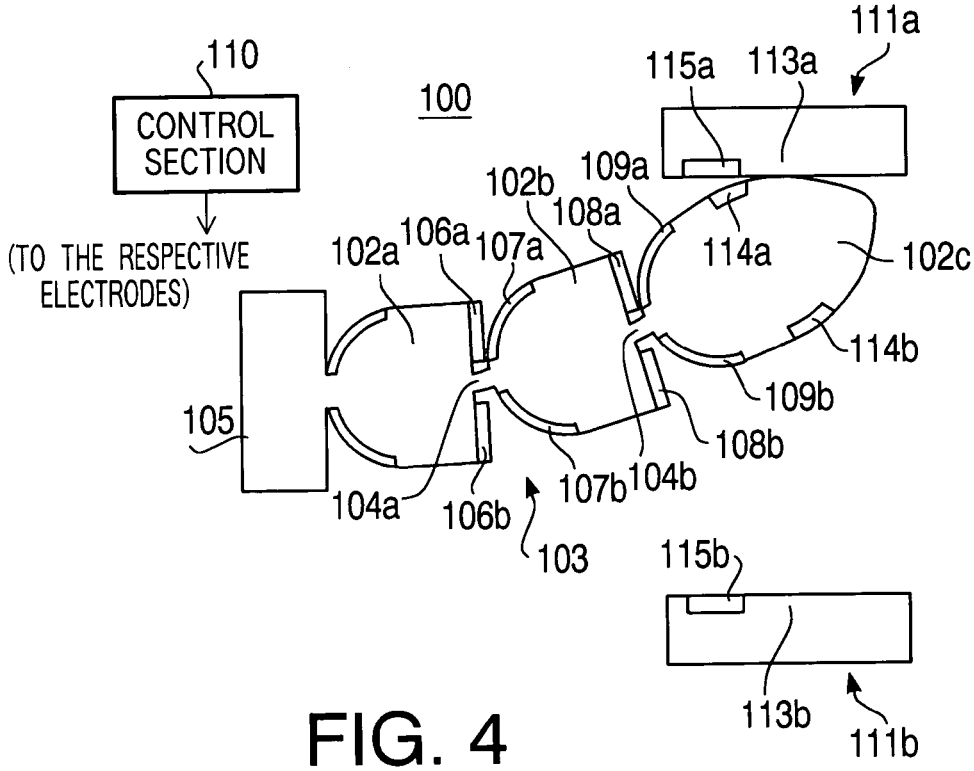
FIG. 4 is a plan view showing the configuration of the switch in accordance with embodiment 1 of the present invention.

Wiring patterns, not shown in the figure, are provided for the respective surface electrodes 106*a*, 106*b*, 107*a*, 107*b*, 108*a*, 108*b*, 109*a* and 109*b* to provide predetermined control signal lines (not shown) through which a DC potential is applied. Accordingly, by applying a DC potential to the surface electrodes 106*a*, 107*a*, 108*a* and 109*a* in one side of the respective microstructures 102*b* and 102*c* and applying a zero potential to the surface electrodes 106*b*, 107*b*, 108*b* and 109*b* in the other side, an electrostatic attractive force is generated between the surface electrodes 106*a* and 107*a* and between the surface electrodes 108*a* and 109*a* and therefore, as illustrated in FIG. 4, the microstructure 102*c* at the distal end of the microstructure group 103 is moved to abut on a substrate side output section 111*a* in one side, with the microstructure 102*a* as a supporting point, while the microstructure 102*c* is then maintained abutting the substrate side output section 111*a*.

Figure 5:
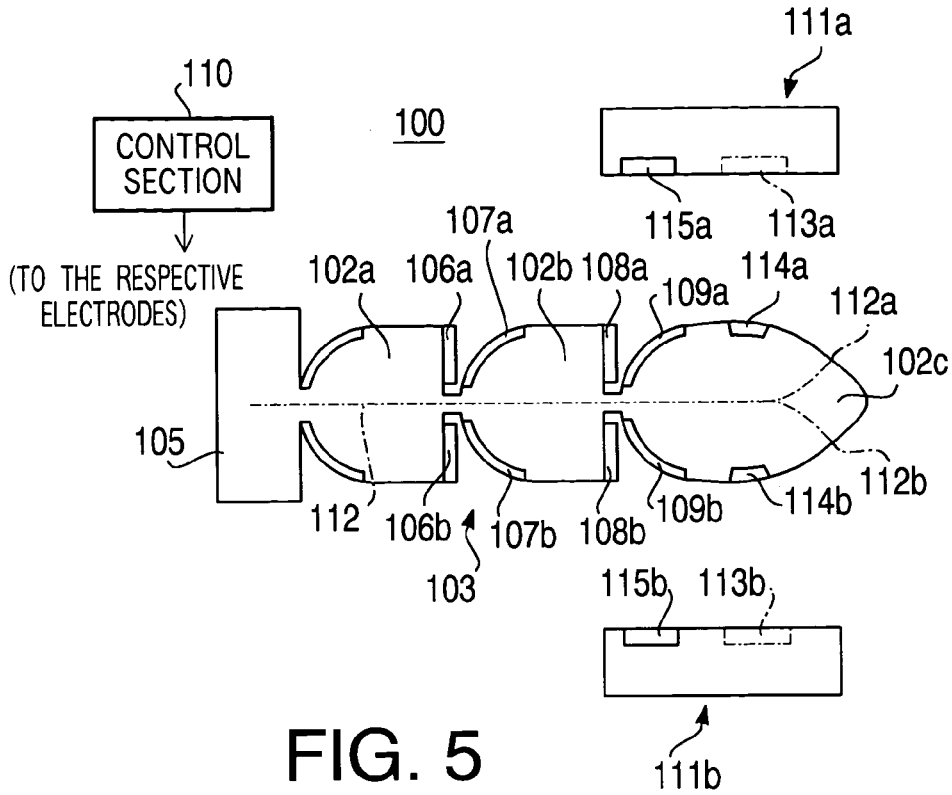
FIG. 5 is a plan view showing the configuration of the switch in accordance with embodiment 1 of the present invention.
Figure 6:
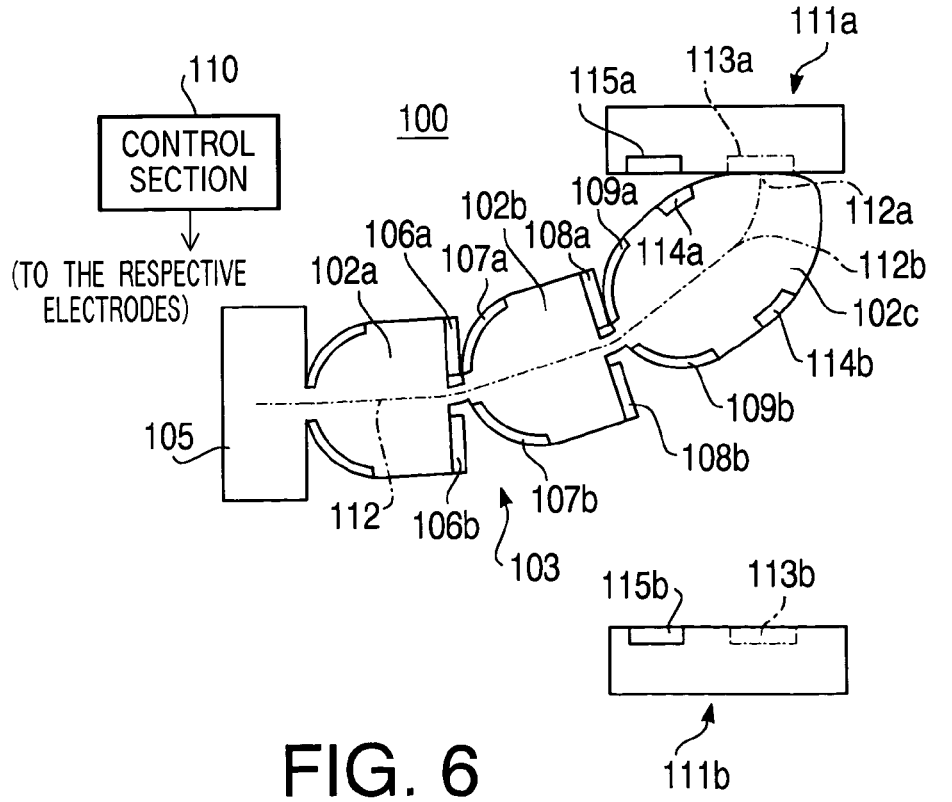
FIG. 6 is a plan view showing the configuration of the switch in accordance with embodiment 1 of the present invention.

As described above, this microstructure group 103 can be used as the switch 100 by the pivoting motion of the microstructure group 103 in accordance with the potential applied to the surface electrodes 106*a*, 106*b*, 107*a*, 107*b*, 108*a*, 108*b*, 109*a* and 190*b*. That is, as illustrated in FIG. 5 and FIG. 6 in which like references are used to describe like elements as in FIG. 3 and FIG. 4, by providing wiring patterns 112 on the microstructure group 103 and the substrate side electrodes 113*a* and 113*b* on substrate side output sections 111*a* and 111*b* provided in the substrate side, the output terminal 112*a*, i.e., the end of the wiring pattern 112 of the above microstructure 102*c* comes into contact with the substrate side electrode 113*a* of the substrate side output section 111*a* when the microstructure 102*c* abuts on the substrate side output section 111*a* at the end of the microstructure group 103 by the pivoting motion of the microstructure group 103. As a result, the substrate side input section 105 provided in the substrate side is electrically coupled to the substrate side output section 111*a* through the microstructure group 103 to allow the signal transmission from the substrate side input section 105 to the substrate side output section 111*a*.

Incidentally, the surface electrodes 106*a*, 106*b*, 107*a*, 107*b*, 108*a* 108*b*, 109*a* and 109*b* may be made of, for example, a metal such as gold, aluminum, nickel, copper or an alloy, or a polysilicon material doped with phosphorus to increase the electric conductivity thereof.

In this case, the microstructure 102*c* at the distal edge of the microstructure group 103 is provided with surface electrodes 114*a* and 114*b* in the vicinities of the positions where the substrate side output section 111*a* or 111*b* abuts on. A DC potential is applied to the surface electrode 114*a* or 114*b* in order that, for example, when the DC potential is applied to the surface electrodes 106*a*, 107*a*, 108*a* and 109*a* of the microstructures 102*b* and 102*c*, the DC potential is applied to the surface electrode 114*a* located in the same side.

Accordingly, when the microstructure 102*c* pivots toward the substrate side output section 111*a* by applying the DC potential to the surface electrodes 106*a*, 107*a*, 108*a* and 109*a*, the pivoting motion (traveling operation) of the microstructure 102*c* can be guided by the electrostatic attractive force generated between a guide electrode 115*a* formed on the substrate side output section 111*a* and the surface electrode 114*a* of the microstructure 102*c*. By this configuration, the microstructure 102*c* can abut accurately on a predetermined location of the substrate side output section 111*a*.

Also, when a DC potential is applied to the surface electrodes 106*b*, 107*b*, 108*b* and 109*b* of the microstructures 102*b* and 102*c*, the DC potential is applied to the surface electrode 114*b* in the same side.

Accordingly, when the microstructure 102*c* pivots toward the substrate side output section 111*b* by applying the DC potential to the surface electrodes 160*b*, 107*b*, 108*b* and 109*b*, the pivoting motion (traveling operation) of the microstructure 102*c* can be guided by the electrostatic attractive force generated between a guide electrode 115*b* formed on the substrate side output section 111*b* and the surface electrode 114*b* of the microstructure 102*c*. By this configuration, the microstructure 102*c* can abut accurately on a predetermined location of the substrate side output section 111*b*. With the above configuration of the switch 100 made of the microstructure group 103, in which a plurality of microstructures 102*a*, 102*b* and 102*c* are linked in series, the amount of movement of the microstructure 102*c* as a contact point of the above switch 100 for coming into contact with the substrate side output section 111*a* or 111*b* is only the amount of movement corresponding to the pivoting motion relative to the microstructure 102*b* which is linked to the microstructure 102*c*. Also, the amount of movement of the microstructure 102*b* is only the amount of movement corresponding to the pivoting motion relative to the microstructure 102*a* which is linked to that microstructure 102*b*.

As described above, the microscopic movements of the microstructures 102*a*, 102*b* and 102*c* linked to each other are summed up to widely move the microstructure 102*c* located at the end of the microstructure group 103 between the substrate side output sections 111*a* and 111*b*. Accordingly, with the respective microstructures 102*b* and 102*c* to which is given microscopic pivoting motion by only applying an extremely small DC potential, required for the microscopic pivoting motion, between the surface electrodes 106*a*, 107*a*, 108*a* and 109*a* or between the surface electrodes 106*b*, 107*b*, 108*b* and 109*b*, the switch 1 capable of operating at a lower DC potential can be realized.

Also, since the surface electrodes 107*a*, 107*b*, 109*a* and 109*b* provided in the respective microstructures 102*b* and 102*c* have curved surfaces, there is always formed microscopic gaps between the surface electrodes 106*a* and 107*a* and between the surface electrodes 108*a* and 109*a*, or microscopic gaps between the surface electrodes 106*b* and 107*b* and between the surface electrodes 108*b* and 109*b* to induce a large electrostatic attractive force even in either position of the pivoting position of the microstructure group 103 as illustrated in FIG. 4 and the neutral position without pivoting motion as illustrated in FIG. 3. Accordingly, it is possible to operate the switch 100 at a further lower DC potential.

Also, by providing the substrate side output sections 111*a* and 111*b* with the guide electrodes 115*a* and 115*b* and by guiding the movement of the microstructure 102*c* by these guide electrodes 115*a* and 115*b*, the positioning accuracy can be improved when the microstructure group 103 pivots with its microstructure 102*c* abutting on the substrate side output section 111*a* or 111*b*. Also, during the pivoting motion of the microstructure group 103, the microstructure 102*c* is attracted toward the substrate side output section 111*a* or 111*b* by the electrostatic attractive force generated between the surface electrode 114*a* or 114*b* and the guide electrode 115*a* or 115*b* of the microstructure 102*c*, and thereby a quicker responsive operation of the switch 100 becomes possible. Also, it is possible to easily control the contact pressure between the microstructure 102*c* and the substrate side electrode 113*a* or 113*b* by adjusting the DC potential to be applied to the guide electrode 115*a* or 115*b*.

Figure 7:
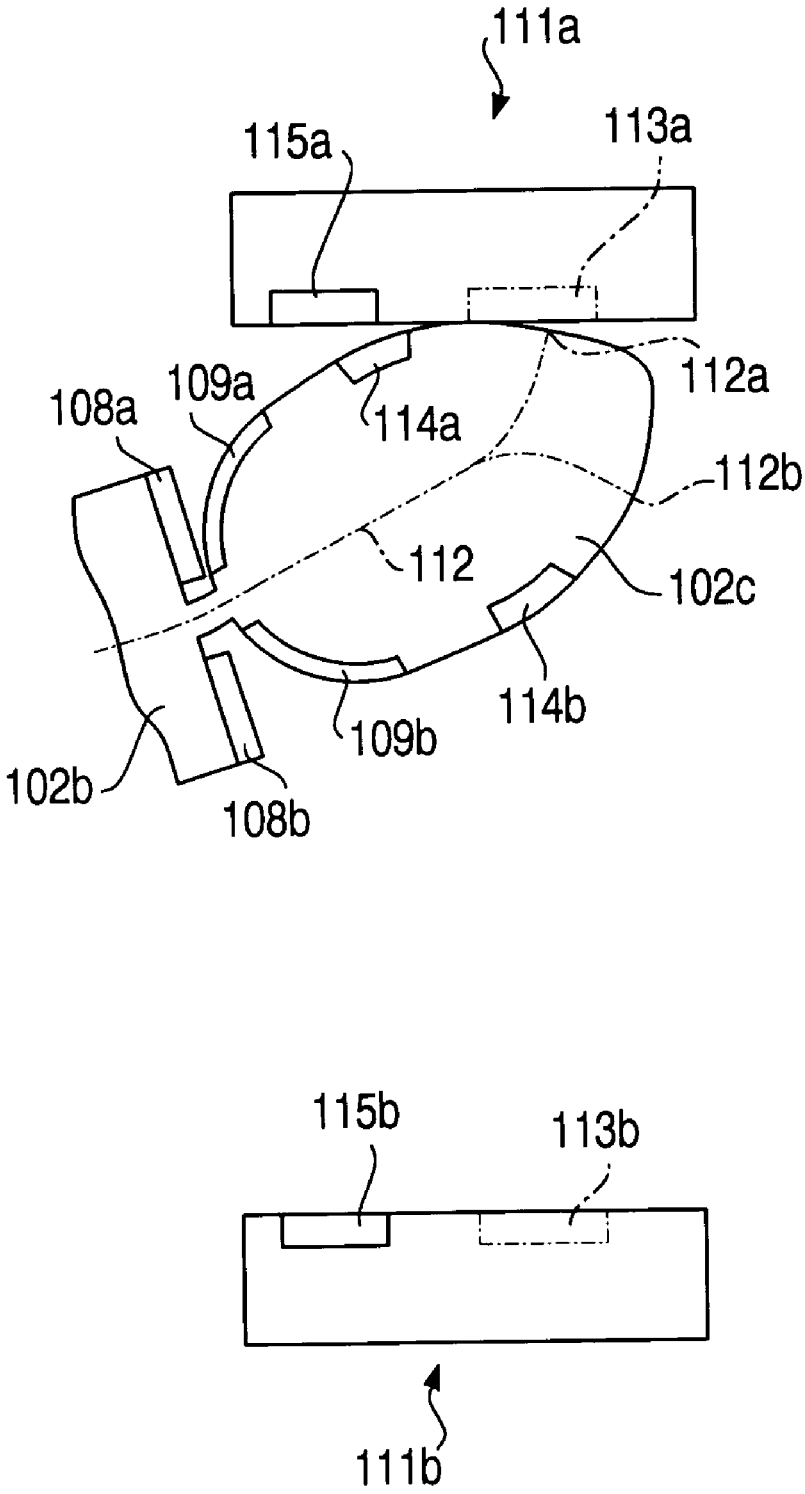
FIG. 7 is a partial plan view showing the configuration of the switch in accordance with embodiment 1 of the present invention.

Incidentally, in order to couple the output terminal 112*a* or 112*b* of the microstructure 102*c* with the substrate side electrode 113*a* or 113*b* during the switching operation, the metal constituting the output terminal 112*a* or 112*b* is brought into direct contact with the metal constituting the substrate side electrode 113*a* or 113*b* to form a resistive coupling (FIG. 6), or alternatively a capacitive coupling can be used through a microscopic gap or a thin insulating film therebetween. In this case, in order to capacitively couple the output terminal 112*a* or 112*b* with the substrate side electrode 113*a* or 113*b* through a microscopic gap, the microstructure 102*c* is designed to have the output terminal 112*a* (or 112*b*) and the substrate side electrode 113*a* (or 113*b*) with a gap in between when the microstructure 102*c* abuts on the substrate side output section 111*a* (or 111*b*) as illustrated in FIG. 7. Also, in order to capacitively couple the output terminal 112*a* or 112*b* with the substrate side electrode 113*a* or 113*b* through a thin insulating film intervening therebetween, in the configuration as illustrated in FIG. 6, the above insulating film is formed on the surface of the microstructure 102*c* or the surfaces of the substrate side output sections 111*a* and 111*b* so that the insulating film is located to intervene between the output terminal 112*a* (or 112*b*) and the substrate side electrode 113*a* (or 113*b*) when the microstructure 102*c* abuts on the substrate side output section 111*a* (or 111*b*).

In accordance with the switch 100 of the present embodiment, it is therefore possible to perform a high speed switching operation at a further lower DC potential.

Figure 8:
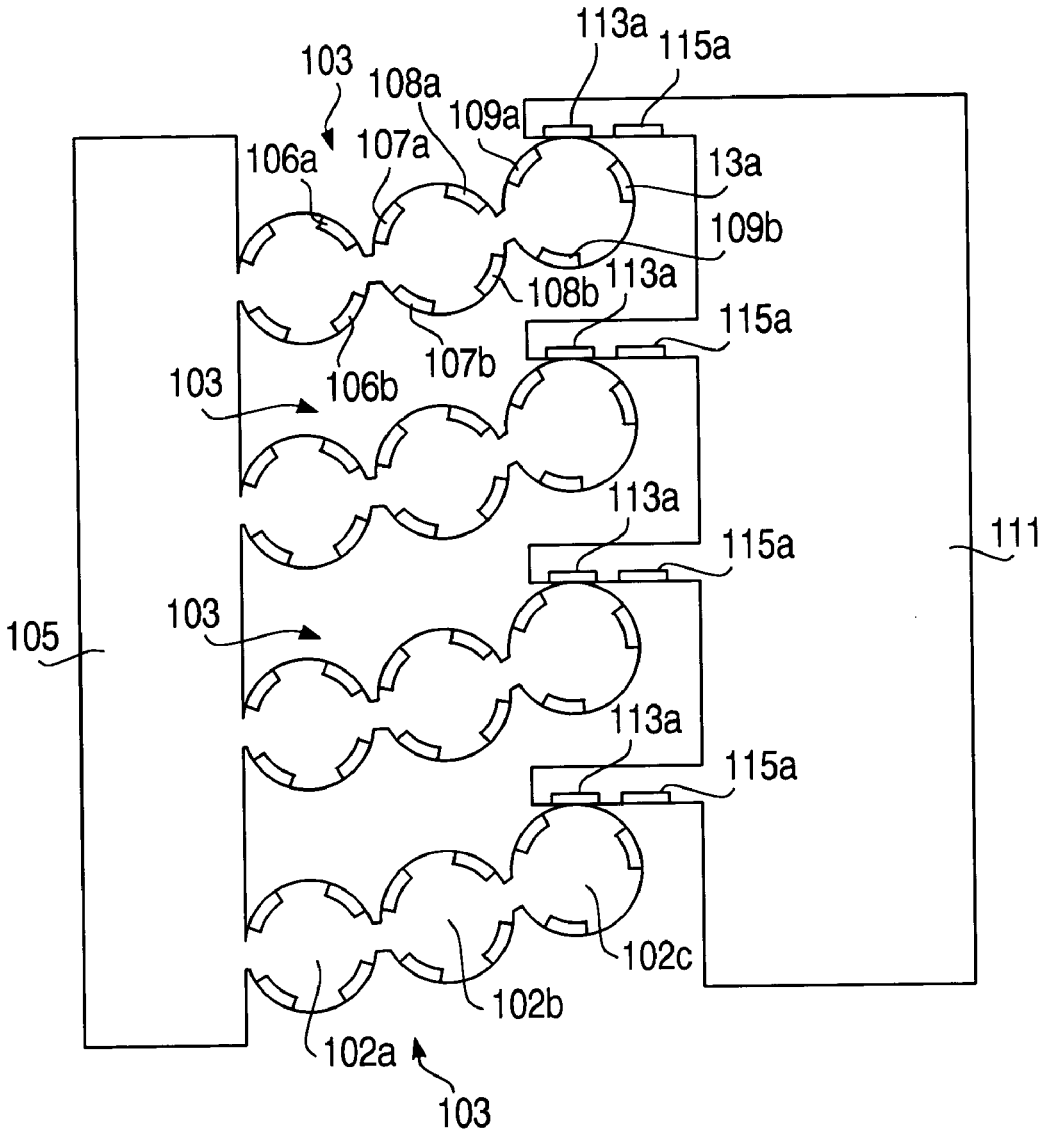
FIG. 8 is a plan view showing an exemplary modification of the switch in accordance with embodiment 1 of the present invention.

Incidentally, while the switch 100 has only one microstructure group 103 in the case of the embodiment as described above, the present invention is not limited thereto and, for example, as illustrated in FIG. 8 in which like references are used to describe like elements as in FIG. 6, a plurality of the same groups as the microstructure group 103 may be arranged in parallel. By this configuration, in a case that the above capacitive coupling is formed in the configuration as shown in FIG. 7, it is possible to avoid the decrease in the degree of coupling due to the small size of the microstructure 102*c* by making use of the plural structure to equivalently increase the area of the device, and also in a case that the above resistive coupling is formed in the configuration as shown in FIG. 5, it is possible to avoid the increase in the conductor loss due to the small area of the output terminal 112*a*. Incidentally, the microstructures 102*a*, 102*b* and 102*c* illustrated in FIG. 8 may be designed to have a shape of a flat circular disk.

Figure 9:
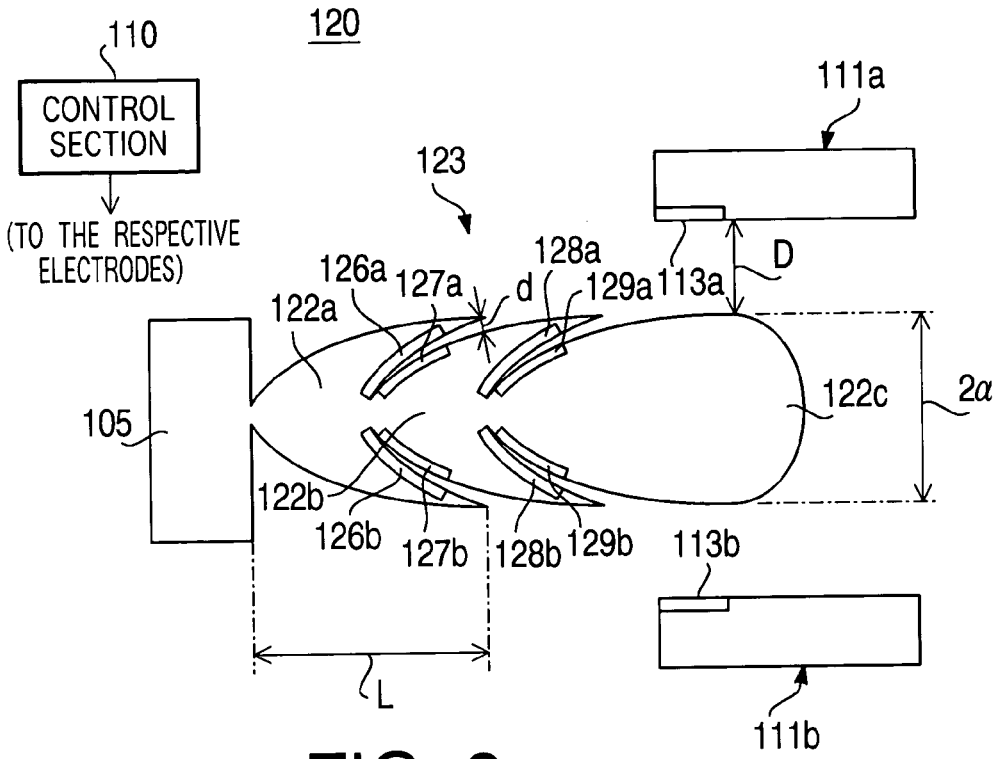
FIG. 9 is a plan view showing the exemplary modification of the switch in accordance with embodiment 1 of the present invention.
Figure 10:
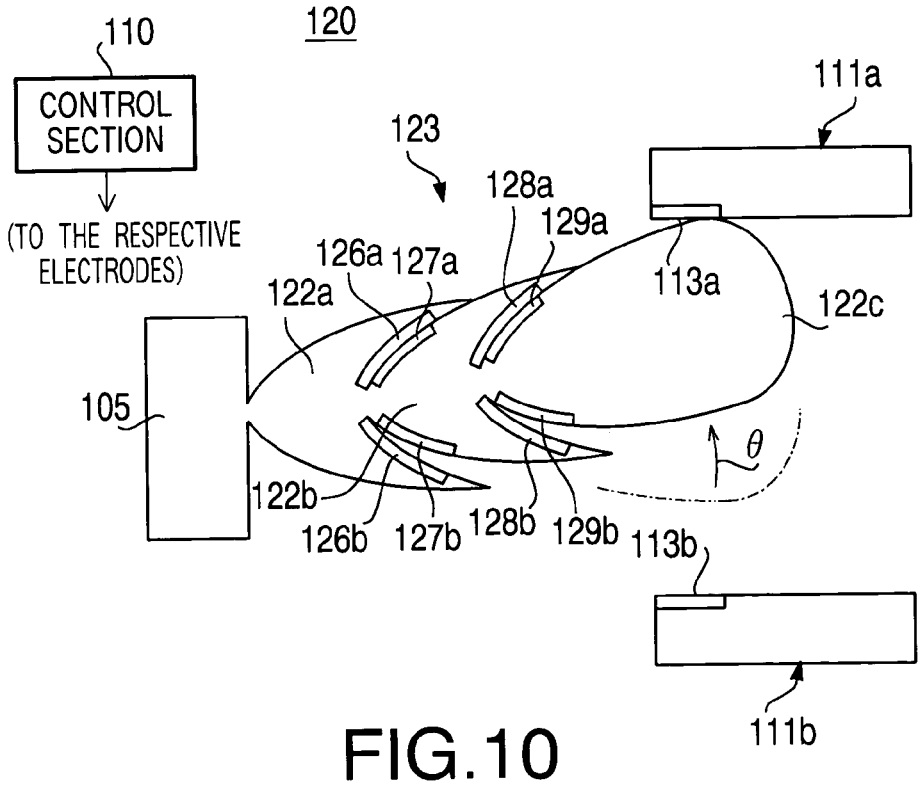
FIG. 10 is a plan view showing an exemplary modification of the switch in accordance with embodiment 1 of the present invention.

Also, while the microstructure group 103 having the microstructures 102*a*, 102*b* and 102*c* as illustrated in FIG. 3 to FIG. 6 is used in the embodiment as described above, the present invention is not limited thereto, and the design as illustrated in FIG. 9 and FIG. 10 can be used. Namely, FIG. 9 and FIG. 10 in which like references are used to describe like elements as in FIG. 3 to FIG. 6 are plan views showing the configuration of a switch 120 in accordance with another embodiment. The switch 120 has microstructures 122*a*, 122*b* and 122*c*.

FIG. 9 shows a microstructure group 123 as a movable member in its neutral position while FIG. 10 shows the microstructure group 123 as a movable member which is moved to abut on the substrate side output section 111*a* in one side. The profiles of the microstructures 122*a*, 122*b* and 122*c* (the profiles of the curved surfaces on which are formed the surface electrodes 126*a*, 126*b*, 127*a*, 127*b* and 128*a*) as illustrated in FIG. 9 and FIG. 10 are formed as profiles to maximize the respective electrostatic attractive forces between the surface electrodes 126*a* and 127*a*, between the surface electrodes 128*a* and 129*a*, between the surface electrodes 126*b* and 127*b* and between the surface electrodes 128*b* and 129*b*. That is, the distance between the microstructure 122*c* and the substrate side output section 111*a* (111*b*) is D, and the length and the width of the microstructure 122*a*, 122*b* or 122*c* are L and 2α respectively.

Also, with the microstructure group 123 being in its neutral position as illustrated in FIG. 9, the maximum distance between the surface electrodes 126*a* and 127*a*, between the surface electrodes 128*a* and 129*a*, between the surface electrodes 126*b* and 127*b* and between the surface electrodes 128*b* and 129*b* is d.

The distance between the microstructure 122*c* and the substrate side output section 111*a* (111*b*) is uniquely defined in accordance with the frequency of the signal passing through this switch 120, the isolation as required and the cross section area of the output terminal of the microstructure 122*c* (corresponding to the output terminals 112*a* and 112*b* as shown in FIG. 5 and FIG. 6). In this case, if the cross section area of the output terminal, the frequency of the signal and the isolation as required are 2500 $\mu m^2$, 5 GHz and 30 dB respectively, then a sufficient isolation can be achieved from a practical standpoint by securing the distance D of no smaller than 1 μm.

The maximum tilt angle θ (FIG. 10) of the respective microstructures 122*a*, 122*b* and 122*c* is calculated as $\theta=\tan^{-1}(d/L)$. For example, when the three microstructures 122*a*, 122*b* and 122*c* are linked in series, the location $(x_3, y_3)$ of the curved surface outlining the profile of the microstructure 122*c* (hereinafter referred to simply as the location of the microstructure 122*c*) can be calculated by (Eq. 1) to (Eq. 5) as follows.

Figure 11:
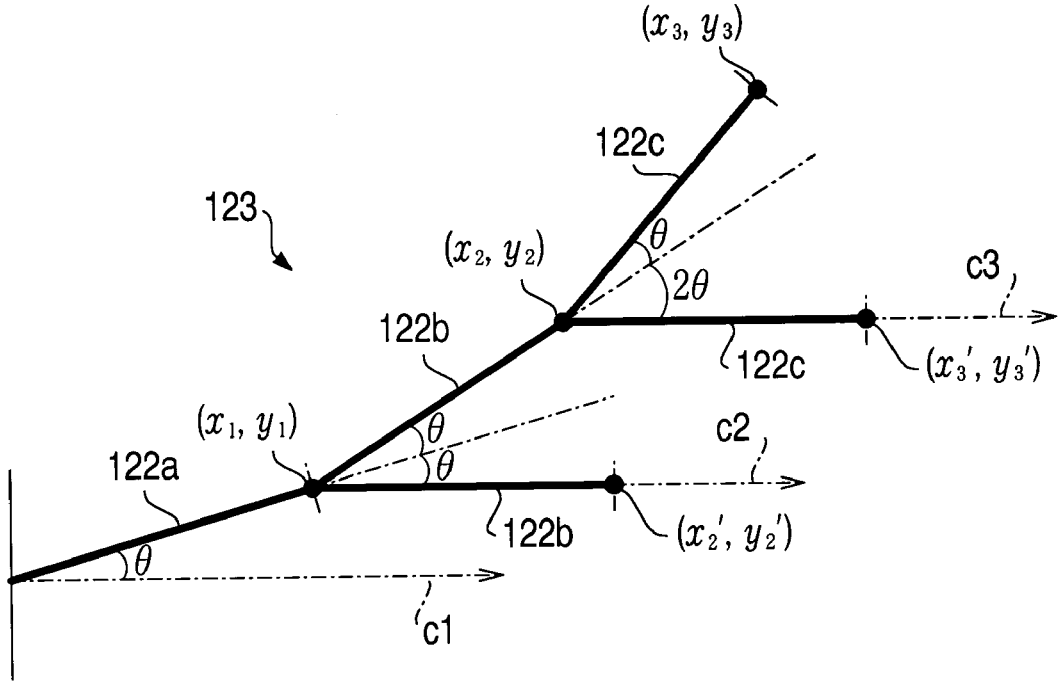
FIG. 11 is a schematic diagram showing the operational mechanism of the exemplary modification of the switch in accordance with embodiment 1 of the present invention.

That is, as illustrated in FIG. 11, in a case that the first microstructure 122*a* located in the side of the substrate side input section 105 is tilted by an angle θ relative to the direction c1 (θ=0) without a tilt, the location $(x_1, y_1)$ of the above first microstructure 122*a* is expressed by the following (Eq. 1).

$$\begin{pmatrix} x_1 \\ y_1 \end{pmatrix} = \begin{pmatrix} \mathrm{Cos}\theta & -\mathrm{Sin}\theta \\ \mathrm{Sin}\theta & \mathrm{Cos}\theta \end{pmatrix} \begin{pmatrix} L \\ 0 \end{pmatrix} \quad \text{(Eq. 1)}$$

With the result of this (Eq. 1), by performing the calculation in accordance with the following (Eq. 2) on the assumption that the second microstructure 122*b* is oriented in the direction c2 (θ=0) without a tilt from the first microstructure 122*a* which is tilted by the angle θ, the location $(x_2', y_2')$ of this second microstructure 122*b* is obtained.

$$\begin{pmatrix} x_2' \\ y_2' \end{pmatrix} = \begin{pmatrix} x_1 \\ y_1 \end{pmatrix} + \begin{pmatrix} L \\ 0 \end{pmatrix} \quad \text{(Eq. 2)}$$

With the location $(x_2', y_2')$ of the second microstructure 122*b* expressed by this (Eq. 2), the location $(x_2, y_2)$ of this second microstructure 122*b* tilted by the angle 2θ is obtained by the following (Eq. 3).

$$\begin{pmatrix} x_2 \\ y_2 \end{pmatrix} = \begin{pmatrix} \mathrm{Cos}2\theta & -\mathrm{Sin}2\theta \\ \mathrm{Sin}2\theta & \mathrm{Cos}2\theta \end{pmatrix} \begin{pmatrix} x_2' \\ y_2' \end{pmatrix} \quad \text{(Eq. 3)}$$

This location $(x_2, y_2)$ is the location of the second microstructure 122*b* which is tilted by the angle θ relative to the first microstructure 122*a* tilted by the tilt angle θ (i.e., which is tilted by the angle 2θ relative to the direction c2 (θ=0) without a tilt).

With the result of this (Eq. 3) , by performing the calculation in accordance with the following (Eq. 4) on the assumption that the third microstructure 122*c* is oriented in the direction c3 (θ=0) without a tilt from the second microstructure 122*b* which is tilted by the angle 2θ relative to the direction of c2 (θ=0) without a tilt, the location $(x_3', y_3')$ of this third microstructure 122*c* is obtained.

$$\begin{pmatrix} x_3' \\ y_3' \end{pmatrix} = \begin{pmatrix} x_2 \\ y_2 \end{pmatrix} + \begin{pmatrix} L \\ 0 \end{pmatrix} \quad \text{(Eq. 4)}$$

With the location ($x_3'$, $y_3'$) of the third microstructure 122*c* expressed by this (Eq. 4) , the location ($x_3$, $y_3$) of this third microstructure 122*b* tilted by the angle 3θ relative to the direction of c3 without a tilt is obtained by the following (Eq. 5).

$$\begin{pmatrix} x_3 \\ y_3 \end{pmatrix} = \begin{pmatrix} \mathrm{Cos}3\theta & -\mathrm{Sin}3\theta \\ \mathrm{Sin}3\theta & \mathrm{Cos}3\theta \end{pmatrix} \begin{pmatrix} x_3' \\ y_3' \end{pmatrix} \quad \text{(Eq. 5)}$$

This location ($x_3$, $y_3$) is the location of the third microstructure 122*c* which is tilted by the angle θ relative to the second microstructure 122*b*, which is tilted by the tilt angle 2θ0, while the first microstructure 122*a* is tilted by the tilt angle θ.

As described above, in the case of the switch 120 making use of the microstructures 122*a*, 122*b* and 122*c* illustrated in FIG. 9 and FIG. 10 in the same manner as the switch 100 described above in conjunction with FIG. 3 to FIG. 6, pivoting motion can be given to the microstructure group 123 to perform a switching operation by applying a predetermined DC potential to the surface electrodes 126*a*, 126*b*, 127*a*, 127*b*, 128*a*, 128*b*, 129*a* and 129*b* of the microstructures 122*a*, 122*b* and 122*c* to generate electrostatic attractive forces. In the case of this switch 120, while the respective microstructures 122*a*, 122*b* and 122*c* have the curved surface profiles designed in accordance with the above (Eq. 1) to (Eq. 5), it is possible to generate the maximum electrostatic attractive forces by virtue of the surface electrodes 126*a*, 126*b*, 127*a*, 127*b*, 128*a*, 128*b*, 129*a* and 129*b* formed on these curved surfaces.

EMBODIMENT 2

Figure 12:
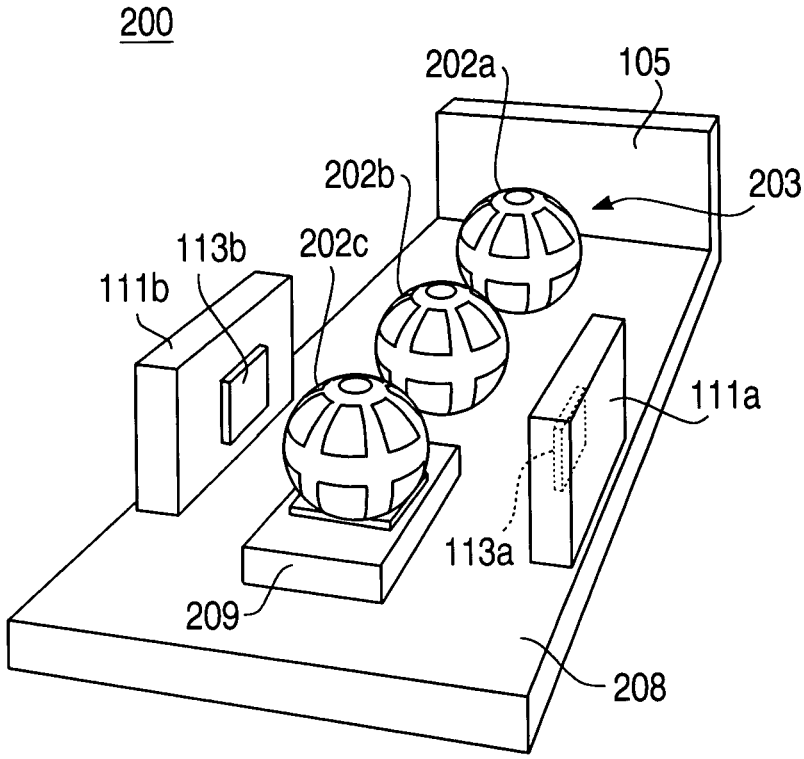
FIG. 12 is a perspective view showing the configuration of a switch in accordance with embodiment 2 of the present invention.

FIG. 12 is a perspective view showing the configuration of a switch 200 in accordance with an embodiment 2 of the present invention. However, like reference numerals indicate similar elements as illustrated in FIG. 3 to FIG. 6, and detailed explanation will be omitted.

The switch 200 as shown in FIG. 12 is formed on a semiconductor integrated circuit by the same process as the integrated circuit and used in the transmitter circuit, the receiver circuit, the transmission/reception switching circuit of a wireless communication device, or in some circuits of a variety of other devices. In contrast to the two-dimensional travel (pivoting motion) of the above switch 100 as described in conjunction with FIG. 3, this switch 200 differs in the three-dimensional travel (pivoting motion). In order to realize the pivoting motion in the three-dimensional direction, this switch 200 has a microstructure group 203 as a movable member having a first microstructure 202*a* pivotally supported in the three-dimensional direction by a substrate side input section 105, a second microstructure 202*b* pivotally supported in the three-dimensional direction in relation to the above first microstructure 202*a*, and a third microstructure 202*c* pivotally supported in the three-dimensional direction in relation to the above second microstructure 202*b*.

The respective microstructures 202*a*, 202*b* and 202*c* constituting this microstructure group 203 are formed approximately as spheres, while surface electrodes are provided as control electrodes respectively on the surfaces of these spherical microstructures 202*a*, 202*b* and 202*c*.

Figure 13:
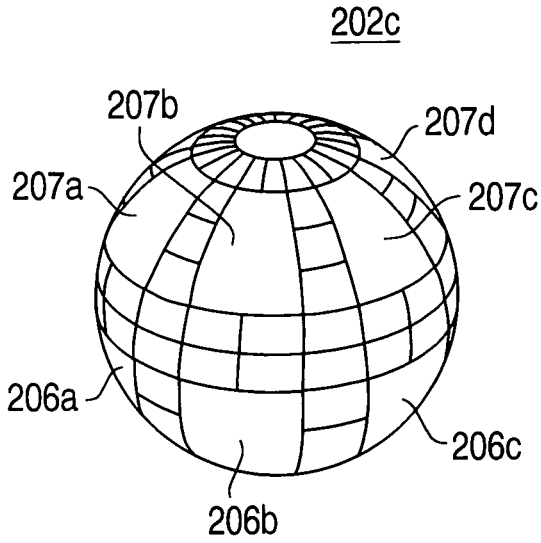
FIG. 13 is a perspective view showing the microstructure of the switch in accordance with embodiment 2 of the present invention.

FIG. 13 is a perspective view showing the surface configuration of the third microstructure 202*c*. However, the other microstructures 202*a* and 202*b* have the same configuration as this third microstructure 202*c*.

In FIG. 13, the microstructure 202*c* is provided, on its surface, with the surface electrodes 206*a*, 206*b*, 206*c* . . . and 207*a*, 207*b*, 207*c*, 207*d* . . . . In the same manner as the switch 100 shown in FIG. 3 to FIG. 6, the pivoting motion is given to the microstructure group 203 by selectively applying a predetermined DC potential to the surface electrodes 206*a*, 206*b*, 206*c* . . . , and 207*a*, 207*b*, 207*c*, 207*d*, . . . .

Figure 14:
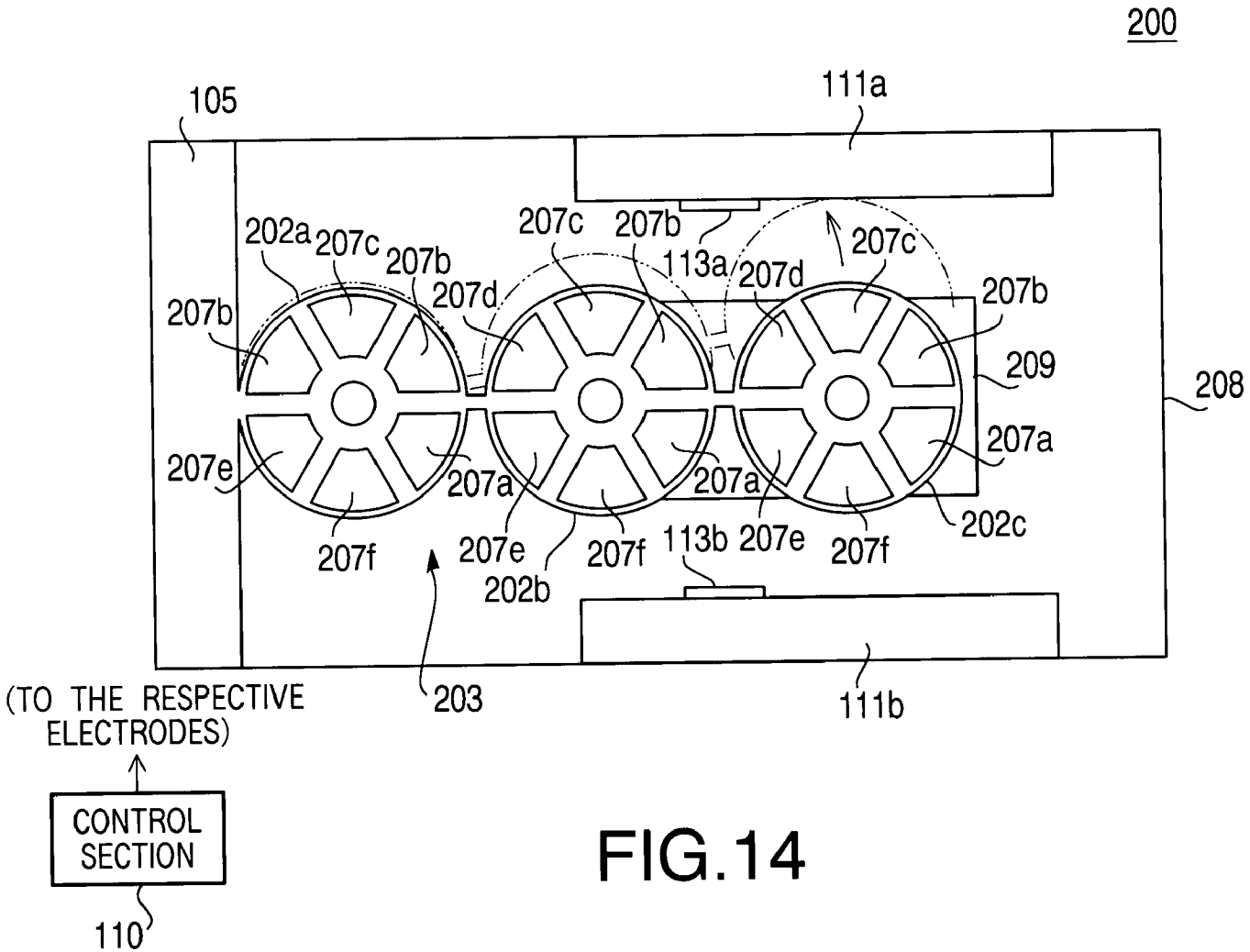
FIG. 14 is a top view showing the switch in accordance with embodiment 2 of the present invention.

Namely, FIG. 14 is a top view showing the switch 200 with the microstructure group 203 having the respective microstructures 202*a*, 202*b* and 202*c* having surface electrodes 206*a*, 206*b*, 206*c* . . . , and surface electrodes 207*a*, 207*b*, 207*c*, 207*d*, . . . among which appropriate electrodes are selected in order to generate an electrostatic attractive force between the adjacent surface electrodes (207*b* and 207*d*, 207*a* and 207*e*, 206*b* and 206*d*, and 206*a* and 206*e*) by applying a DC potential to the selected electrodes.

By this configuration, the microstructure group 203 is given a pivoting motion in the right or left direction as illustrated with a chained line in FIG. 14 in accordance with the DC potential applied thereto from the control section 110 through a predetermined control signal line (not shown in the figure). The switch 200 has a substrate base section 208 provided with substrate side output sections 111*a* and 111*b*, and the microstructure 202*c* pivoting in the lateral direction abuts on the substrate side output section 111*a* or 111*b* so that the terminals of the wiring patterns formed on the abutting surfaces come into contact with each other in order to perform a switching operation. Also, while the substrate side output sections 111*a* and 111*b* are provided with the substrate side electrodes 113*a* and 113*b*, the electrostatic attractive force for attracting the microstructure 202*c* can be generated between the substrate side electrodes 113*a* and 113*b* and the surface electrode of the microstructure 202*c* by applying a DC potential to this substrate side electrode 113*a* or 113*b*. By this configuration, it is possible to perform a high speed switching operation of the switch 200.

Incidentally, the microstructure group 203 is configured to be supported in its neutral position. This configuration may be such that the microstructure group 203 in its neutral position is supported in relation to the surface electrodes 206*a*, 206*b*, 206*c* . . . , and the surface electrodes 207*a*, 207*b*, 207*c*, 207*d*, . . . of the microstructures 202*a*, 202*b* and 202*c* by applying a DC voltage, or alternatively the microstructure group 203 is supported by a predetermined resilient supporting member (not shown in the figure).

Figure 15:
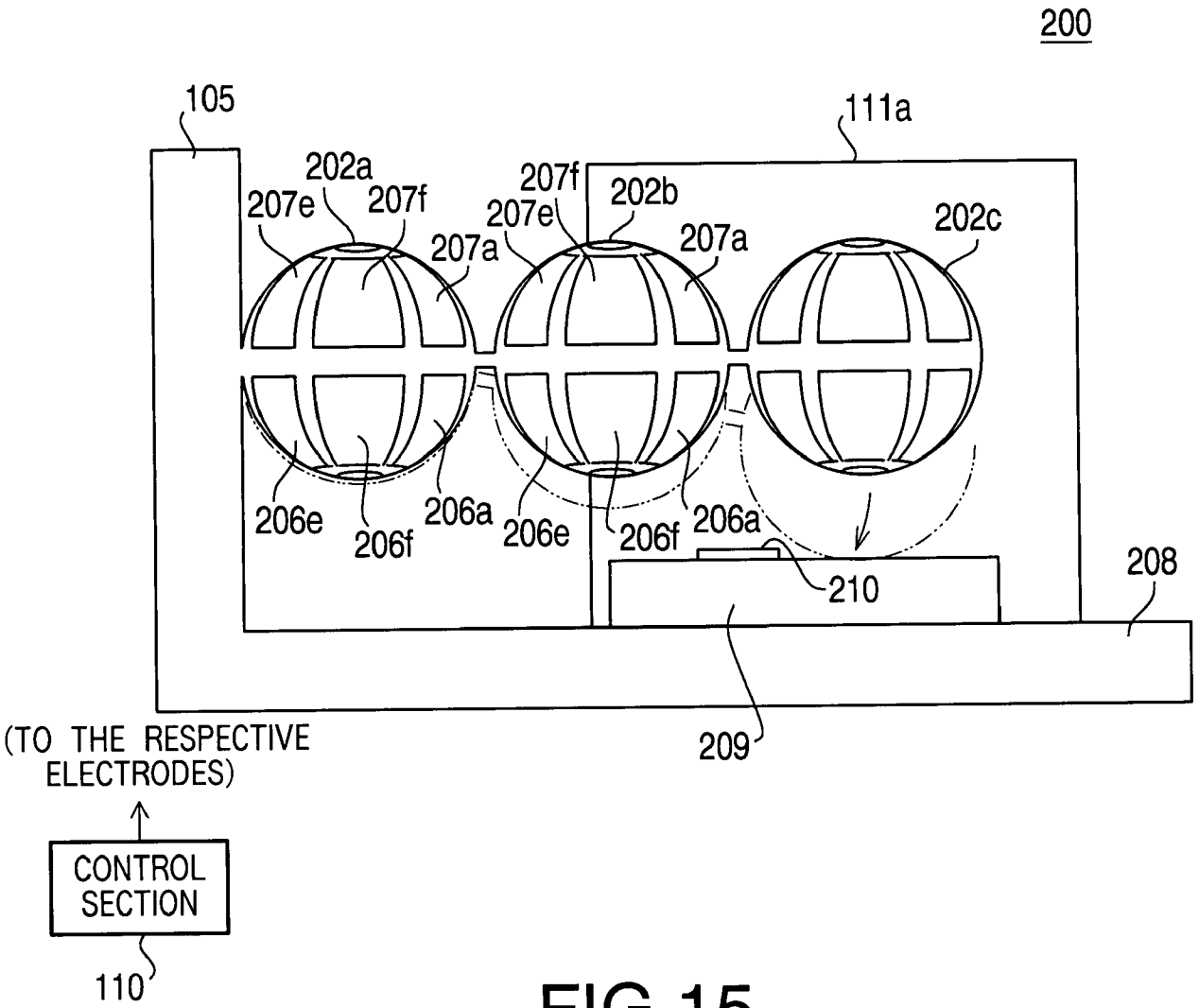
FIG. 15 is a side view showing the switch in accordance with embodiment 2 of the present invention.

Also, FIG. 15 is a side view showing the switch 200 with the microstructure group 203 having the respective microstructures 202*a*, 202*b* and 202*c* having surface electrodes 206*a*, 206*b*, 206*c* . . . among which appropriate electrodes are selected in order to generate an electrostatic attractive force between each opposite surface electrodes (206*b* and 206*d*, and 206*a* and 206*e*) by applying a DC potential to the selected surface electrodes.

By this configuration, as illustrated with a chained line in FIG. 15, the microstructure group 203 is given a pivoting motion in the downward direction in accordance with the DC potential as applied. The substrate base section 208 of the switch 200 is provided with a substrate side output section 209, and the microstructure 202*c* pivoting in the downward direction abuts on the substrate side output section 209 so that the terminals of the wiring patterns formed on the abutting surfaces come into contact with each other in order to perform a switching operation. Also, this substrate side output section 209 is provided with a substrate side electrode 210. By applying a DC potential to this substrate side electrode 210, the electrostatic attractive force for attracting the microstructure 202*c* can be generated between the substrate side electrode 210 and the surface electrode of the microstructure 202*c*, and therefore it is possible to perform a high speed switching operation by the pivoting motion of the microstructure group 203 in the downward direction.

Also, while the switching operation is performed by the pivoting motion of the microstructure group 203 from its neutral position in the downward direction in embodiment 2 as described above, the present invention is not limited thereto, and another substrate side output section is provided above the microstructure group 203 to give the microstructure group 203 pivoting motions in the upward and downward directions.

Also, while the microstructure group 203 is given pivoting motions to the microstructure group 203 in the right and left directions and the upward and downward directions in embodiment 2 as described above, the present invention is not limited thereto, and the microstructure group 203 can be arranged in order to pivot in any of various directions. By this configuration, by providing a plurality of directions for switching operations in addition to the right and left directions and the upward and downward directions and providing substrate side output sections in the additional directions, it is possible to enable the operation of switching between a plurality of contact points.

EMBODIMENT 3

Figure 16:
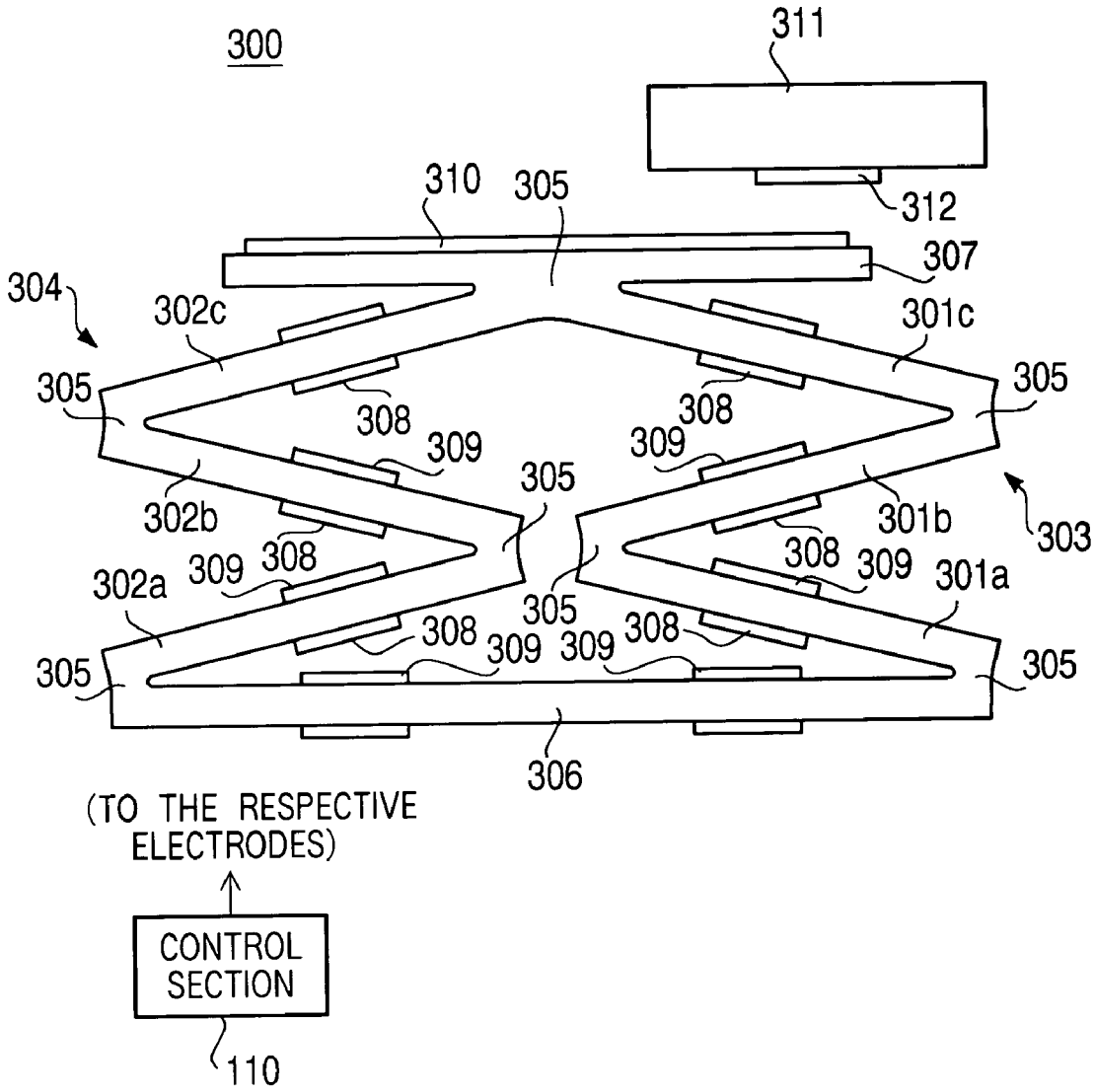
FIG. 16 is a side view showing the configuration of a switch in accordance with embodiment 3 of the present invention.

FIG. 16 is a side view showing the configuration of a switch 300 in accordance with an embodiment 3 of the present invention. The switch 300 as shown in FIG. 16 is formed on a semiconductor integrated circuit by the same process as the integrated circuit and used in the transmitter circuit, the receiver circuit, the transmission/reception switching circuit of a wireless communication device, or in some circuits of a variety of other devices. This switch 300 includes, as a movable member, microstructure groups 303 and 304 having the microstructures 301*a*, 301*b*, 301*c*, 302*a*, 302*b* and 302*c* in place of the microstructures 102*a*, 102*b* and 102*c* of the above switch 100 as shown in FIG. 3.

The microstructure group 303 is formed by linking the respective microstructures 301*a*, 301*b* and 301*c* by the linking beams 305 with its fixed end linked to a fixed member 306 fixed to a substrate (not shown in the figure) approximately at the right angle and its movable end linked to a movable member 307. Also, the microstructure group 304 is formed by linking the respective microstructures 302*a*, 302*b* and 302*c* by the linking beams 305 with its fixed end linked to the fixed member 306 fixed to the substrate (not shown in the figure) approximately at the right angle and its movable end linked to the movable member 307.

By this configuration, the respective microstructure groups 303 and 304 can expand and contract in the direction of one horizontal axis on the substrate. Accordingly, the movable member 307 provided at the movable end of these microstructure groups 303 and 304 is movable in association with the expansion and contraction of the microstructure groups 303 and 304 in the direction of one horizontal axis on the substrate.

The respective microstructures 301*a*, 301*b*, 301*c*, 302*a*, 302*b* and 302*c* are provided respectively with surface electrodes 308 and 309 as control electrodes in the positions which are located opposed to each other when the respective microstructures 301*a*, 301*b*, 301*c*, 302*a*, 302*b* and 302*c* are contracted. It is thereby possible to generate an electrostatic attractive force between the opposite surface electrodes 308 and 309 by applying, from the control section 110 through the predetermined control signal line (not shown in the figure), a DC potential to the surface electrode 308 and by applying a zero potential to the surface electrode 309 opposite thereto. By this configuration, when the electrostatic attractive force is generated between the respective surface electrodes 308 and 309, the microstructure groups 303 and 304 change their positions so as to contract respectively. As a result, the movable member 307 fixed to the distal end of the microstructure groups 303 and 304 is attracted close to the fixed member 306.

In contrast to this, by applying a DC potential to the respective surface electrodes 308 and 309 located opposed to each other in such a way that generates a repulsive force respectively, the microstructure groups 303 and 304 change their positions so as to extend respectively. As a result, the movable member 307 is moved apart from the fixed member 306, and thereby a signal line 310 provided on this movable member 307 abuts on a signal electrode 312 provided on a substrate side output section 311. By this configuration, the fixed member 306 electrically communicates with the substrate side output section 311 through the microstructure groups 303 and 304, the signal line 310 and the signal electrode 312 abutting thereon. Incidentally, in this case, a signal can be directly passed through these microstructure groups 303 and 304 by making the microstructure groups 303 and 304 with a conductive material, or alternatively signal lines are separately provided on the microstructure groups 303 and 304 for passing signals.

Then, it is possible to perform the expansion and contraction of the microstructure groups 303 and 304 by switching the DC potential applied to the respective surface electrodes 308 and 309, thereby enabling the switching operation of the switch 300 having these microstructure groups 303 and 304.

As described above, in accordance with the switch 300 of the present embodiment, by applying DC potentials to the surface electrodes 308 and 309 as control electrodes provided on the microstructure groups 303 and 304 for generating an electrostatic attractive force or a repulsive force therebetween, it is possible to reduce the amounts of movement of the respective microstructures 301*a*, 301*b*, 301*c*, 302*a*, 302*b* and 302*c* and increase the total amounts of movement of the microstructure groups 303 and 304. As a result, it is possible to provide the high isolation switch 300 that is capable of responding at a high rate and that can operate at a very small DC potential.

Meanwhile, while above embodiment 3 is described with a resistive coupling as an electrically coupling structure between the signal line 310 and the signal electrode 312 which come in direct contact with each other, the present invention is not limited thereto, and the signal line 310 and the signal electrode 312 may be coupled through a predetermined microscopic gap therebetween to form a capacitive coupling.

EMBODIMENT 4

Figure 17:
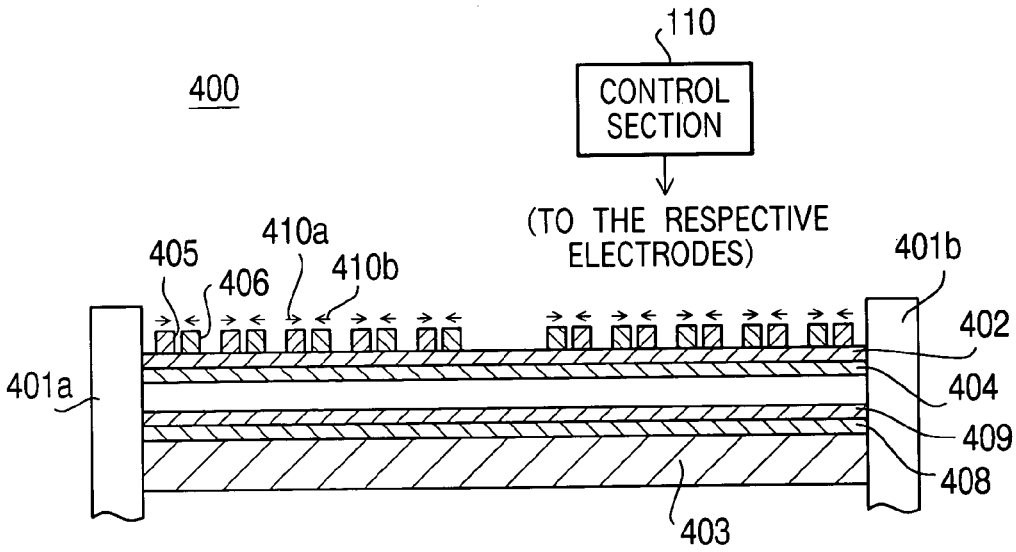
FIG. 17 is a side view showing the configuration of a switch in accordance with embodiment 4 of the present invention.
Figure 18:
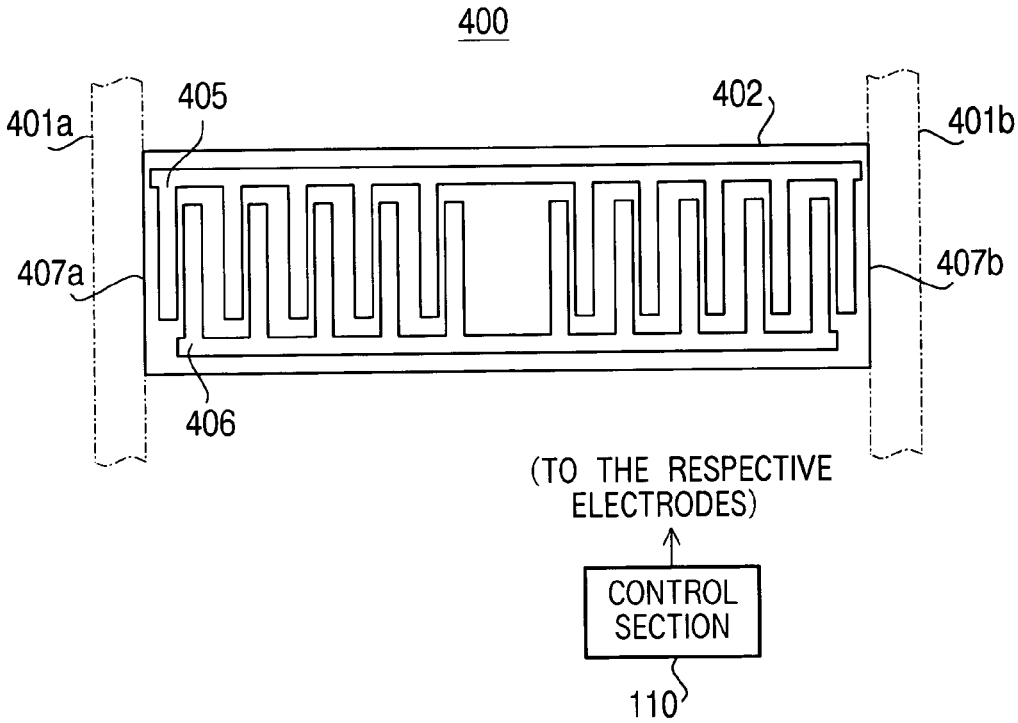
FIG. 18 is a top view showing the switch in accordance with embodiment 4 of the present invention.

FIG. 17 is a side view showing the configuration of a switch 400 in accordance with an embodiment 4 of the present invention, and FIG. 18 is a top view showing the switch 400. The switch 400 as shown in FIG. 17 and FIG. 18 is formed on a semiconductor integrated circuit by the same process as the integrated circuit and used in the transmitter circuit, the receiver circuit, the transmission/reception switching circuit of a wireless communication device, or in some circuits of a variety of other devices. This switch 400 is a switch of another configuration to which is applied the mechanism of the switching operation of the above switch 100 as shown in FIG. 3 in which is utilized the electrostatic attractive force induced with the surface electrodes 106*a*, 106*b*, 107*a*, 107*b*, 108*a*, 108*b*, 109*a* and 109*b*.

That is, in FIG. 17 and FIG. 18, the switch 400 has a double supported beam 402, as a movable member, of which both ends are supported by supporting sections 401*a* and 401*b*, and the double supported beam 402 is located with a slight gap between this double supported beam 402 and a substrate 403. The surface of the double supported beam 402 facing the substrate 403 is formed with an electrode 404, and the opposite surface is formed with comb electrodes 405 and 406.

Figure 19:
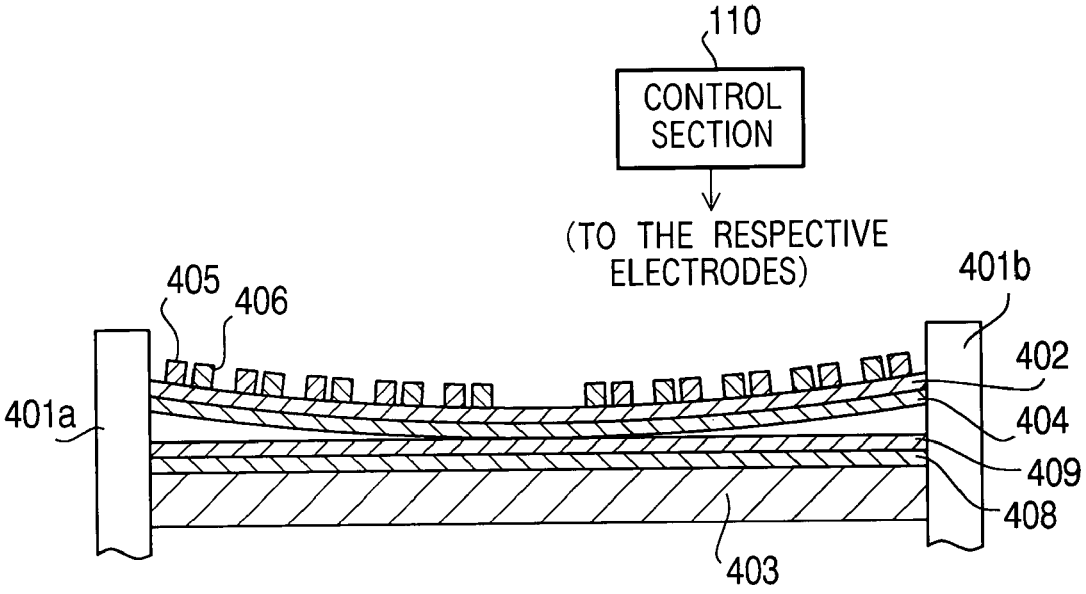
FIG. 19 is a side view showing the configuration of the switch in accordance with embodiment 4 of the present invention.

An input signal is input from an input terminal 407*a* and transferred to an output terminal 407*b* through the electrode 404 to be passed through this switch 400. At this time, when a DC potential is applied to the electrode 404 from the control section 110 through a predetermined control signal line (not shown in the figure) , the double supported beam 402 is bended as illustrated in FIG. 19 by the electrostatic force induced between the electrode 404 and a substrate side electrode 408 to decrease the gap and have the substrate 403 and the double supported beam 402 come in contact with each other.

In this case, the substrate side electrode 408 is provided with a thin insulation-film 409 in order to avoid the DC coupling between the double supported beam 402 and the substrate side electrode 408. Alternatively, this insulation-film 409 may be provided on the double supported beam 402, or provided on both the substrate 403 and the double supported beam 402.

When the gap between the substrate 403 and the double supported beam 402 is substantially decreased, the signal passing through the electrode 404 of the double supported beam 402 is transferred to the substrate 403 rather than the output terminal 407*b* by electrically coupling with the substrate side electrode 408. A short-circuit type switch is constructed by grounding this substrate 403. Incidentally, if the substrate 403 is linked to another signal line in place of ground, a changeover switch can be constructed.

When the double supported beam 402 bends, a DC potential is applied to the comb electrodes 405 and 406 from the control section 110 through a predetermined control signal line (not shown in the figure) to generate an electrostatic attractive force effective for urging each adjacent ones of the comb electrodes 405 and 406 in the directions of arrows 410*a* and 410*b* respectively, resulting in a compressive stress in the double supported beam 402. This compressive stress serves as a force to bend the double supported beam 402 toward the substrate 403. The force to bend the double supported beam 402 cooperates with the electrostatic force between the double supported beam 402 and the substrate 403 to enable a furthermore quick bend of the double supported beam 402 toward the substrate 403. Also, by this configuration, it is possible to drive the switch 400, in its entirety, with a lower voltage applied thereto as compared with the case where the double supported beam 402 bends only by the electrostatic force between the substrate 403 and the double supported beam 402.

As described above, in accordance with the switch 400 of the present embodiment, a faster switching operation becomes possible.

EMBODIMENT 5

Figure 20:
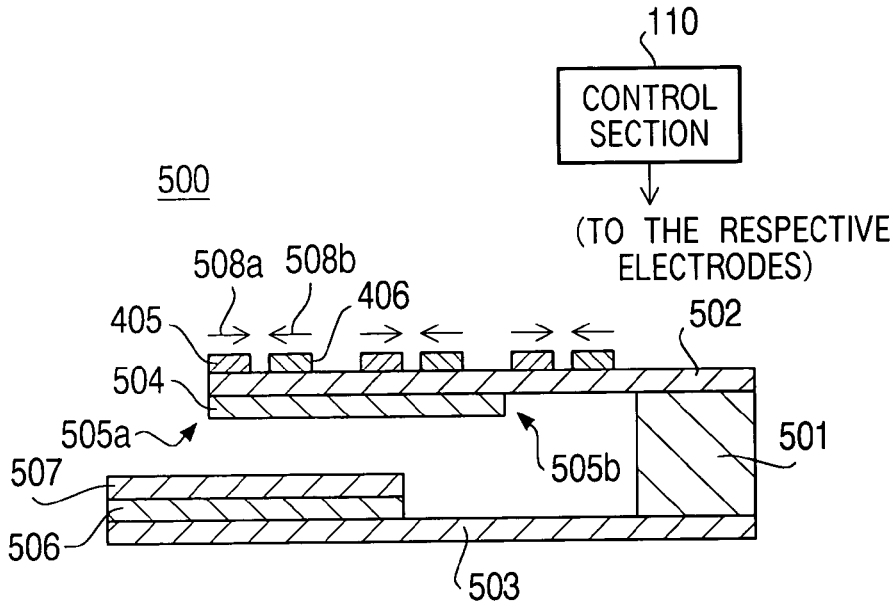
FIG. 20 is a side view showing the configuration of a switch in accordance with embodiment 5 of the present invention.

FIG. 20 is a side view showing the configuration of a switch 500 in accordance with an embodiment 5 of the present invention, in which like references indicate similar elements as in FIG. 17 and FIG. 18 to omit detailed explanation. The switch 500 as shown in FIG. 20 is formed on a semiconductor integrated circuit by the same process as the integrated circuit and used in the transmitter circuit, the receiver circuit, the transmission/reception switching circuit of a wireless communication device, or in some circuits of a variety of other devices. This switch 500 is a switch of another configuration to which is applied the mechanism of the switching operation of the above switch 100 as shown in FIG. 3 in which is utilized the electrostatic attractive force induced with the surface electrodes 106*a*, 106*b*, 107*a*, 107*b*, 108*a*, 108*b*, 109*a* and 109*b*.

In FIG. 20, the switch 500 has a cantilever beam 502, as a movable member, of which one end is supported by a supporting section 501, and the cantilever beam 502 is located with a slight gap between this cantilever beam 502 and a substrate 503. The surface of the cantilever beam 502 facing the substrate 503 is formed with an electrode 504, and the opposite surface is formed with comb electrodes 405 and 406. The comb electrodes 405 and 406 are the same as described in conjunction with FIG. 18.

An input signal is input from an input terminal 505*a* and transferred to an output terminal 505*b* through the electrode 504 to be passed through this switch 500. At this time, when a DC potential is applied to the electrode 504 from the control section 110 through a predetermined control signal line (not shown in the figure), the cantilever beam 502 bends by the electrostatic force induced between the electrode 504 and a substrate side electrode 506 to decrease the gap and have the substrate 503 and the cantilever beam 502 come in contact with each other.

In this case, the substrate side electrode 506 is provided with a thin insulation-film 507 in order to avoid the DC coupling between the cantilever beam 502 and the substrate side electrode 506. Alternatively, this insulation-film 507 may be provided on the cantilever beam 502, or provided on both the substrate 503 and the cantilever beam 502.

When the gap between the substrate 503 and the cantilever beam 502 is substantially decreased, the signal passing through the electrode 504 of the cantilever beam 502 is transferred to the substrate 503 rather than the output terminal 505*b* by electrically coupling with the substrate side electrode 506. A short-circuit type switch is constructed by grounding this substrate 503. Incidentally, if the substrate 503 is linked to another signal line in place of ground, a changeover switch can be constructed.

When the cantilever beam 502 is separated from the substrate side electrode 506, a DC potential is applied to the comb electrodes 405 and 406 to generate an electrostatic attractive force effective for urging each adjacent ones of the comb electrodes 405 and 406 in the directions of arrows 508*a* and 508*b* respectively, resulting in a compressive stress in the cantilever beam 502 to bend the above cantilever beam 502. This compressive stress serves as a force to separate the cantilever beam 502 from the substrate 503. By virtue of this compressive stress, the force to separate the cantilever beam 502 from the substrate 503 cooperates with the inherent recovering force of the cantilever beam 502 to enable a further quick separation of the cantilever beam 502 from the substrate 503 (the substrate side electrode 506).

As described above, in accordance with the switch 500 of the present embodiment, a faster switching operation becomes possible.

Figure 21:
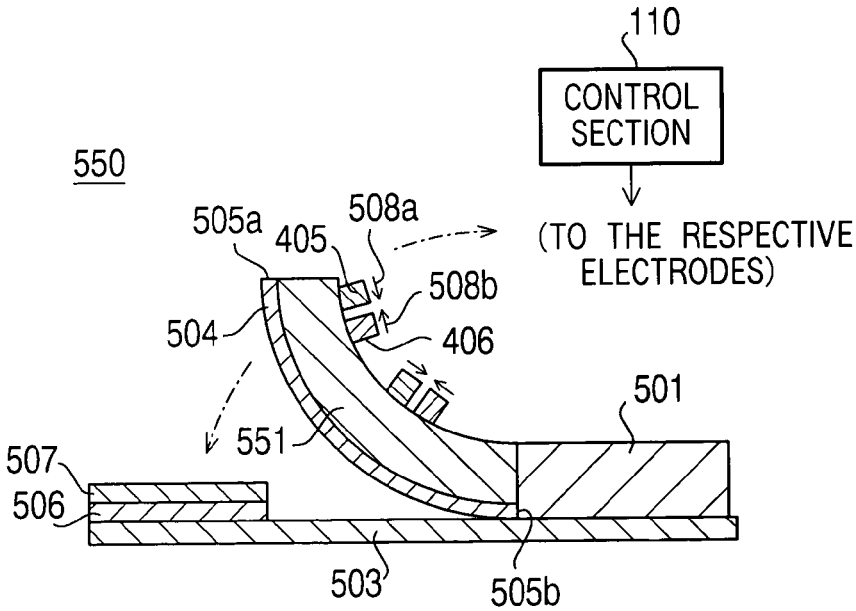
FIG. 21 is a side view showing a sample modification of the switch in accordance with embodiment 5 of the present invention.

While above embodiment 5 is described with the cantilever beam 502 in the form of a flat plane, the present invention is not limited thereto. FIG. 21 is a side view showing a switch 550 as a sample modification of the switch 500 in accordance with the present embodiment. In FIG. 21, like references are used to describe like elements as in FIG. 20. As illustrated in FIG. 21, the switch 550 makes use of a curled cantilever beam 551. By employing a curled shape as the original shape of the cantilever beam 551 as illustrated in FIG. 21, when the cantilever beam 551 is separated from the substrate 503 by applying a DC potential to the comb electrodes 405 and 406 of the cantilever beam 551 being in contact with the substrate 503 by the electrostatic force between the substrate side electrode 506 and the electrode 504, it is possible to more quickly separate the cantilever beam 551 from the substrate 503 by virtue of the strong recovering force of the curled shape itself.

As explained above, in accordance with the present invention, by the use of a microstructure group having microstructures and slightly moving the respective microstructures, it is possible to increase the total amount of movement of the microstructure group. Also, by this configuration, it is possible to reduce the necessary DC potential to be applied to the control electrode of the respective microstructures. Then, it is possible to provide a high isolation switch capable of responding at a high rate at a lower DC potential.

The present specification is based on Japanese Patent Application No. 2002-170613 filed on Jun. 11, 2002, the entire contents of which are incorporated herein.

INDUSTRIAL APPLICABILITY

The present invention is applicable to the switch for use in wireless communication circuits and the like.

The invention claimed is:

1. A switch comprising:

a movable member with a plurality of pairs of surface electrodes on a surface of said movable member;

a first terminal provided on a portion of said movable member; and a second terminal provided on a portion of said movable member and configured to output a signal passing between said second terminal and said first terminal to a predetermined external terminal, wherein said switch switches between passing and blocking of said signal between said second terminal and said predetermined external terminal by a modification of a shape of said movable member due to an electrostatic attractive force induced between said plurality of pairs of surface electrodes.

2. The switch according to claim 1, wherein at least one of said plurality of surface electrodes has a curved configuration.

3. The switch according to claim 1, wherein profiles of the surface electrodes are configured to maximize electrostatic attractive forces between pairs of surface electrodes.

4. The switch according to claim 1, wherein said movable member is configured for two dimensional movement.

5. The switch according to claim 1, wherein said movable member is configured for three dimensional movement.

6. A switch according to claim 1, wherein said movable member has a narrowed portion between said first and second terminals, and the modification of the shape of the switch comprises a relative movement between said first and second terminals about said narrowed portion.

7. The switch according to claim 1, wherein a plurality of said movable members are provided in parallel.

8. The switch according to claim 5, wherein said movable member comprises a generally spherical member.

9. A switch comprising:

a plurality of structures that are provided with a plurality of surface electrodes on a surface of each structure and that are movable in an arbitrary direction;

a beam that transmits an input signal between said structures and that links said structures to each other so that at least two pairs of said surface electrodes on said structures are opposed to each other;

a control signal line that transmits a control signal to each said surface electrode;

an input terminal provided in a structure located at one end of a structure group having said structures linked to each other, said input terminal configured to input said input signal to the structure located at said one end and to fix the structure located at said one end to a substrate; and an output terminal provided in a structure located at the other end of said structure group to output said input signal to a predetermined external terminal, wherein said switch is configured to switch between passing and blocking of said signal between said output terminal and said predetermined external terminal by moving said other end of said structure group by a distance larger than a distance between said surface electrodes by inducing an electrostatic attractive force between said surface electrodes opposed to each other between said structures to change the distance between said surface electrodes, and changing a degree of electrical coupling between said output terminal and said predetermined external terminal.

10. The switch according to claim 9, wherein at least one of the opposed surface electrodes is configured as a curved surface.

11. The switch according to claim 9, wherein said structure group is configured for two dimensional movement.

12. The switch according to claim 9, wherein said structure group is configured for a three dimensional movement.

13. The switch according to claim 9, further comprising a guide electrode that guides a movement of said structure at the other end, wherein an electrostatic attractive force is induced between said guide electrode and said surface electrode on said structure at the other end so that said structure group performs a quick response to the electrostatic attractive force.

14. The switch according to claim 9, wherein a plurality of structure groups are provided in parallel.

15. The switch according to claim 9, wherein profiles of the surface electrodes are configured to maximize electrostatic attractive forces between each of the surface electrodes.

16. The switch according to claim 9, wherein said beam comprises a narrowed portion between adjacent said structures.

17. The switch according to claim 12, wherein each of the said structures comprises a generally spherical element.

18. A switch comprising:

a double supported beam provided on a substrate;

a stationary electrode located directly below said double supported beam;

a movable electrode provided on a surface of said double supported beam facing said substrate; and a plurality of surface electrodes provided on a surface of said double supported beam opposite the surface on which said movable electrode is provided, wherein said switch switches between passing and blocking of a signal between said double supported beam and said substrate by inducing an electrostatic attractive force between said stationary electrode and said movable electrode and inducing an electrostatic attractive force between said plurality of surface electrodes to bend said double supported beam and change a degree of electrical coupling between said double supported beam and said substrate.

19. The switch according to claim 18, wherein said plurality of surface electrodes are comb electrodes.

20. A switch comprising:

a cantilever beam provided on a substrate;

a stationary electrode located directly below said cantilever beam;

a movable electrode provided on a surface of said cantilever beam facing said substrate; and a plurality of surface electrodes provided on a surface of said cantilever beam opposite the surface on which said movable electrode is provided, wherein said switch breaks electrical coupling between the cantilever beam and the substrate by inducing an electrostatic attractive force between said stationary electrode and said movable electrode to bend and electrically couple said cantilever beam with said substrate, and by inducing an electrostatic attractive force between said plurality of surface electrodes to generate a compressive stress in said cantilever beam in a direction of separating said cantilever beam from said substrate.

* * * * *